United States Patent [19]

Prange

[11] Patent Number: 4,838,302

[45] Date of Patent: Jun. 13, 1989

[54] SEWER CLEANING EQUIPMENT

[75] Inventor: Charles J. Prange, Cridersville, Ohio

[73] Assignee: Sewer Rodding Equipment Co., Lima, Ohio

[21] Appl. No.: 151,197

[22] Filed: Feb. 1, 1988

[51] Int. Cl.[4] ..... A62C 35/00; B65H 59/00

[52] U.S. Cl. ..... 137/355.12; 137/355.22; 137/355.26; 242/75.52; 242/86.5 R

[58] Field of Search ..... 137/355.12, 355.22, 137/355.26; 242/75.52, 75.53, 86, 86.5 R, 86.7

[56] References Cited

U.S. PATENT DOCUMENTS

| | | | |
|---|---|---|---|
| 2,214,761 | 9/1940 | Cornell | 137/377 |
| 3,047,198 | 7/1962 | Long | 242/75.52 |
| 4,540,017 | 9/1985 | Prange | 137/355.12 |
| 4,576,337 | 3/1986 | Post | 137/355.12 |
| 4,616,791 | 10/1986 | Harvey | 242/86.5 |

FOREIGN PATENT DOCUMENTS

| | | | |
|---|---|---|---|
| 2527454 | 1/1976 | Fed. Rep. of Germany | 242/86.5 R |

*Primary Examiner*—A. Michael Chambers

*Attorney, Agent, or Firm*—Killworth, Gottman, Hagan & Schaeff

[57] ABSTRACT

Protection apparatus in a mobile sewer cleaning machine having a compartment enclosing a reel and a hose wound thereon. The compartment has an opening through which the hose can be unwound into a sewer through a sewer opening, which leaves a portion of hose between the opening of the compartment and the sewer exposed. The reel and the hose are rotated by a motor to advance the hose through the sewer. The protection apparatus comprises a shield arrangement for enclosing the periphery of the exposed portion of the hose received through an opening therein and extending substantially the full length of the exposed portion of the hose toward the sewer opening. The shield arrangement is fastened to the cleaning machine so that the shield arrangement covers the opening in the compartment. The protection apparatus further comprises sensing means, mounted below the reel and the hose, for sensing the presence of a descending loop of hose from the reel and for providing a stop signal in response thereto, and actuating means, connected to the sensing means, for stopping the motor in response to the stop signal.

29 Claims, 4 Drawing Sheets

10
12
14
16
18
19
20
22
24
26
28
30
32
40
58
99
100
102
104
105
106
107
108
110
112
114
116
118
120
121
122
152
154
1346

SEWER CLEANING EQUIPMENT

BACKGROUND OF THE INVENTION

The present invention relates to mobile sewer cleaning machines and, more particularly, to protection apparatus for shielding a high pressure hose wound on a reel and a sensor for determining when the reel produces excess slack in the hose.

The preferred embodiment of the invention is a component of a mobile sewer cleaning machine that is mounted on a truck body. Machines of this type have been proposed earlier. In many earlier machines, a hose is coiled or wound on a reel that extends transversely in a compartment at one side of the rear of the truck body. A control panel for controlling the reel drive is mounted on the rear of the machine at the other side. An example of such machine is disclosed in U.S. Pat. No. 3,774,630, issued Nov. 27, 1973.

In sewer cleaning systems of this general type, a length of hose is unwound from the reel at the rear of the truck into a sewer. The reel is rotated by a motor which is controlled by the operator standing at the control panel along side the hose. The end of the hose carries a jet nozzle which pulls itself and the hose through the sewer by the force of its rearwardly directed, high pressure water jets, while at the same time washing the debris in the sewer back toward the manhole.

After the nozzle has traveled for a distance through the sewer pipe, the motor connected to the reel is reversed to rewind the hose onto the reel. As the nozzle travels back towards the manhole, the sewer debris is washed ahead of it in the same direction. This process is repeated several times until the length of sewer pipe is cleaned. Because of sharp, abrasive debris in the sewer pipes, hoses become worn out and damaged by this process. If the damage is discovered, the hose is repaired by cutting out the damaged portion and splicing it back together with a fitting. Even though the hose has been repaired, the splice represents a weak spot in the hose. In any event, the water is supplied to the hose at an extremely high pressure, on the order of 2,000 p.s.i., during the process. Such a high pressure can cause a damaged or repaired hose to rupture and burst. If the hose should burst at a point close to the operator, there is substantial possibility of serious injury. Operators have actually been killed by this kind of accident.

Another problem encountered with known sewer cleaning equipment of this type is the tangling which may occur in the hose. This may occur due to the operator standing in a position where he cannot see the hose unwinding, or simply because the operator is not paying attention to the hose. As the nozzle pulls and advances the hose through the sewer line, the hose is unwound from the reel by the motor, the speed and direction of which are controlled by the operator. During this time, the nozzle may encounter a substantial amount of refuse and debris in the sew pipe which momentarily hinders the advancement of the hose. If the operator is aware of the situtation, he monitors the progress of the hose by looking down into the sewer and appropriately adjusts the speed of the motor to match the progress of the nozzle through the sewer. When the operator looks down into the sewer, the operator's view is often obstructed by the steam rising out of the sewer. This is compounded during cold weather when the steam condenses and further obstructs the operator's view. If, on the other hand, the operator does not notice this and reduce the speed of rotation of the reel, the reel will unwind the hose faster than it is being advanced by the nozzle and produce an excess slack of hose. This excess slack in the hose will initially be manifested by a loop of hose descending to the floor of the reel compartment, eventually buckling back within the compartment and possibly becoming wedged or entangled therein.

Accordingly, there is a need for protection apparatus to shield an operator from a bursting hose and to sense when rotation of the reel produces excess slack in the hose.

SUMMARY OF THE INVENTION

The present invention meets these needs by providing protection apparatus in a mobile sewer cleaning machine. The machine has a compartment for enclosing a reel and a hose wound thereon. The compartment has an opening through which the hose can be unwound into a sewer through a sewer opening, which leaves a portion of hose between the opening of the compartment and the sewer exposed. The reel and the hose wound thereon are viewable through the opening in the compartment and rotated by a motor to advance the hose through the sewer. The protection apparatus comprises shield means for enclosing the periphery of the exposed portion of the hose received through an opening therein and extending substantially the full length of the exposed portion of the hose toward the sewer opening. The shield means is fastened to the cleaning machine so that the periphery of the opening of the shield means covers the opening in the compartment. The shield means may have a transparent portion or panel for viewing the reel and the hose. In the event that the hose bursts, the shield means shields the machine operator from the bursting hose, yet allows the reel and hose to remain viewable.

Prior to using the shield means, the operator manually leveled the hose on the reel while it was being wound in and out of the sewer during the cleaning operation. The shield means, however, encloses the hose during the cleaning operation so that the hose is not accessible. Thus, the protection apparatus further comprises leveling means, mounted in the upper area of the compartment and rotationally connected to the reel, for moving the hose laterally in a direction substantially parallel to the rotational axis of the reel as the motor rotates the reel to wind the hose level in successive layers on the reel. The protection apparatus also comprises a slide bar mounted in the upper area of the compartment and a roller, mounted for rotation and lateral movement on the slide bar, that is adapated for receiving the hose from the leveling means and suspending the hose over the sewer opening.

Sometimes a descending loop forms in the hose when the hose is unwound by the motor at a rate which is faster than the rate at which it advances through the sewer. In such case, the protection apparatus further comprises sensing means, mounted below the reel and hose, for sensing the presence of a descending loop of the hose from the reel and for providing a stop signal in response thereto, and actuating means, connected to the sensing means, for stopping the motor in response to such stop signal. In one embodiment the sensing means is an optical sensing means for producing a light beam and for providing said stop signal when the light beam is interrupted by a descending loop. In another embodiment, the sensing means is a mechanical sensing assembly comprising a rod assembly for receiving a descending loop of the hose and downwardly movable in response thereto, and switching means responsive to the downward movement of the rod assembly for providing the stop signal.

If the mobile sewer cleaning machine is suspended above the sewer opening, e.g., when it is mounted on the frame of a truck, the shield means may be extendable in length over the full length of the exposed portion of the hose to cover the sewer opening. Furthermore, the shield means may also have an access portion which can be opened to provide access to the hose.

Accordingly, it is an object of the present invention to provide protection apparatus in a mobile sewer cleaning machine for shielding an operator from the fragments and contents of a bursting hose and for sensing the excess slack in the hose produced by the reel when the hose is unwound from the reel at a rate faster than it advances through the sewer. Other objects and advantages of the invention will be apparent from the following description, the accompanying drawings and the appended claims.

DETAILED DESCRIPTION OF THE PREFERRED EMBODIMENTS

Figure 1:
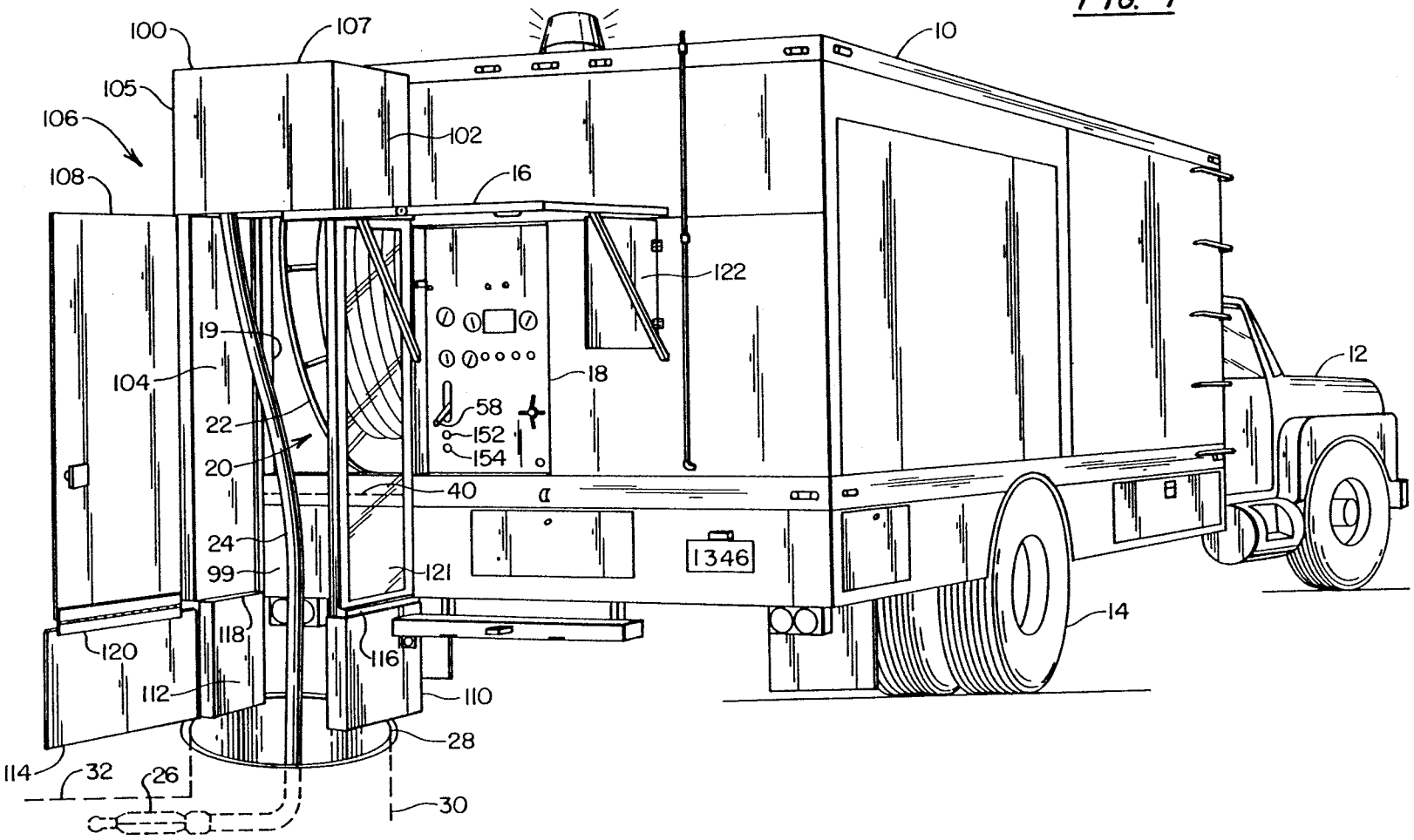
FIG. 1 is a perspective view of a mobile sewer cleaning machine and protection apparatus constructed according to the present invention.

FIG. 1 illustrates a mobile sewer cleaning machine 10, which is mounted on the frame of a truck 12 and suspended off the ground by the wheels 14 of the truck 12. At the rear of the cleaning machine 10, a door 16 is hinged about a horizontal axis to uncover a control panel 18 disposed on one side and a rectangular shaped opening 19 to an internal compartment, indicated generally at 20 on the other side. The compartment 20 encloses a reel 22 on which is wound a hose 24. The hose 24 terminates at its free outer end in a conventional nozzle 26 adapted to be inserted through the sewer opening 28 of a sewer 30 and into a sewer pipe 32 thereof. Thus, a portion of the hose 24 is exposed between the opening 19 to the compartment 20 and the sewer opening 28.

Figure 2:
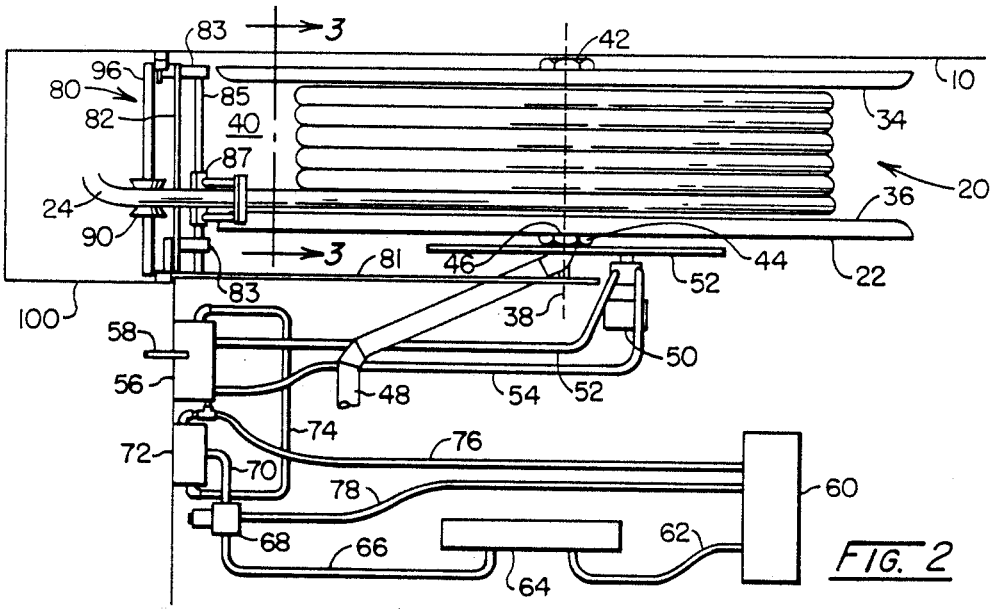
FIG. 2 is a fragmentary plan view of the reel compartment and the equipment compartment in the rear of the mobile sewer cleaning machine.

Referring also to FIG. 2, the reel 22 comprises parallel, large-diameter sides 34 and 36 between which rigidly extends a cylindrical drum (not shown) around which the hose 24 is wound. The reel 22 is mounted for rotation about a horizontal axis 38 and supported over the floor 40 of the reel compartment 20 by bearings 42, 44 on a stationary hollow shaft 46. A manifold (not shown) that is rotatable with respect to the shaft 46 is connected to the inner end of the hose 24 on the reel 22. Water is supplied under pressure up to 2,000 p.s.i. from a pump (not shown) through a conduit 48 into the interior of the shaft 46 where it is transmitted through the manifold to the inner end of the hose 24.

The reel 22 is rotated by a hydraulic motor 50 via a cooperating gear and sprocket assembly 52. The hydraulic motor 50 is connected by hydraulic lines 52 and 54 to a directional valve 56 which is controlled by the operator's use of a lever 58 (FIG. 1) to change the direction of the motor 50. A storage tank 60 provides hydraulic fluid through a hydraulic line 62 to a hydraulic pump 64 which forces the hydraulic fluid through a hydraulic line 66, a hydraulic dump valve 68 and a hydraulic line 70 to a flow divider 72. The flow divider 72 is adjustable to provide the hydraulic fluid through a hydraulic line 74 to the directional valve 56. The directional valve 56 and the flow divider 72 are both connected via a hydraulic line 76, and the hydraulic dump valve 68 is connected via a hydraulic line 78, to return the hydraulic fluid to the storage tank 60.

Figure 7:
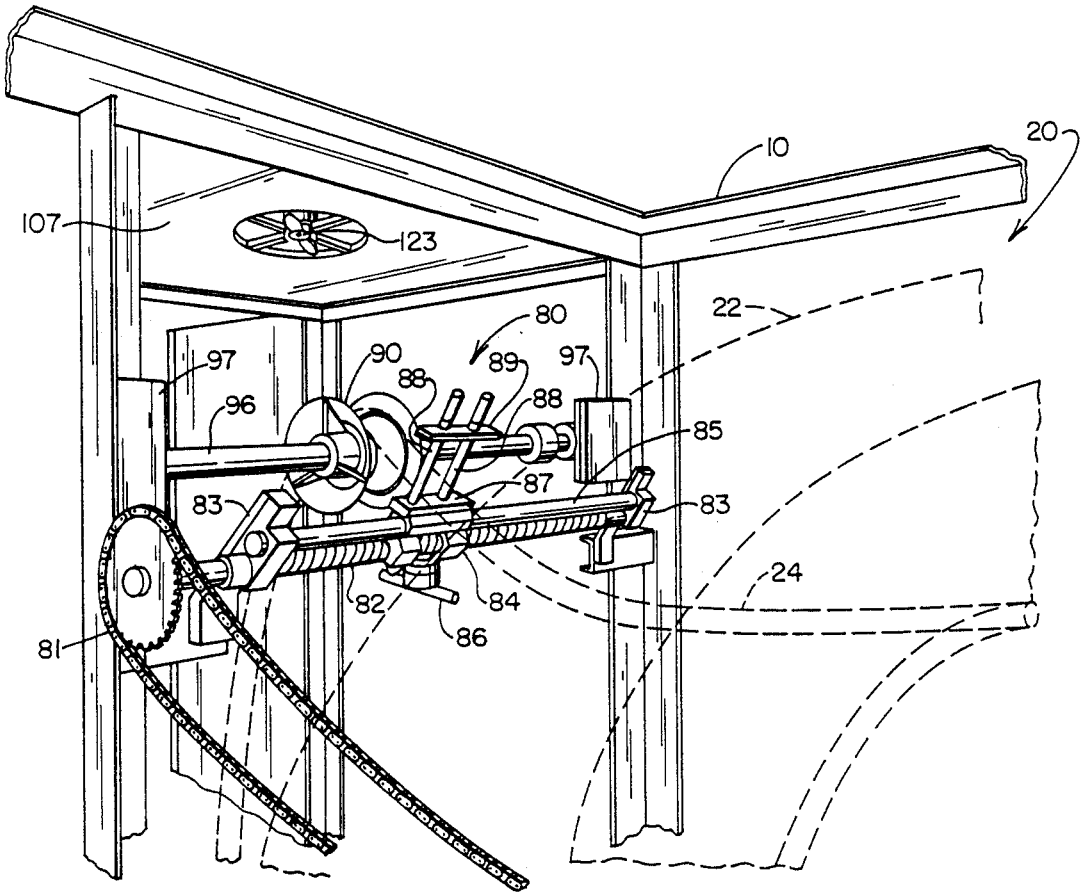
FIG. 7 is a fragmentary perspective view of the rear of the reel compartment and the protection apparatus to show a fan and a level wind according to the present invention.
Figure 8:
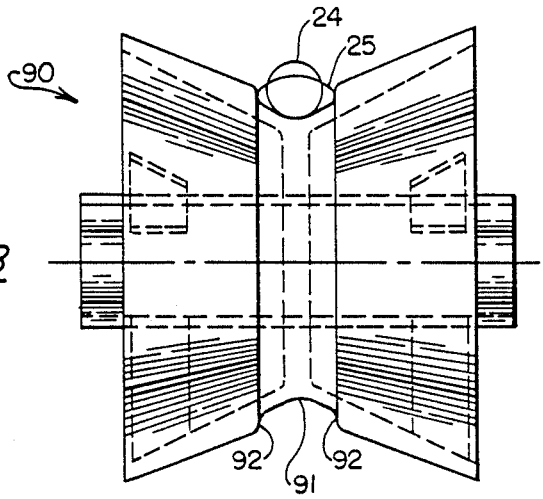
FIG. 8 is a sectional view of the roller of the level wind of FIG. 7 according to the present invention.

Referring to FIGS. 7 and 8, the reel 22 is rotationally connected to a hose level-wind indicated generally at 80 by a sprocket and chain assembly 81. The level-wind 80 comprises a two-directional scroll shaft 82 rotated by the sprocket and chain assembly 81 and journalled for rotation on brackets 83 fastened to the upper area inside of the reel compartment 20 at the rear where the hose 24 exits the cleaning machine 10. The level-wind 80 also comprises a follower-block 84 along a slide bar 84 between the two brackets 83 in a direction substantially parallel the rotational axis of the reel 22. The follower-block 84 includes a directional mechanism 86 which causes the follower-block 84 to change direction when the mechanism 86 engages one of the brackets 83. The level-wind 80 further comprises a hose guide 87 mounted on the follower-block 84 and comprising a pair of finger rollers 88 journalled for parallel rotation between the follower-block 84 and a brace 89. A roller 90 is mounted for rotation and lateral movement on a slide bar 96, mounted by brackets 97 on the rear of the reel compartment 20. The hose 24 is fed through the guide 87 and over the roller 90 which moves laterally along the slide bar 96 with the hose 24 and the guide 87, to wind the hose 24 levelly on the reel 22 is successive layers. The hose 24 extends out of the reel compartment 20 through the opening 19 therein and over the roller 90 which suspends the hose 24 over the sewer opening 28.

Referring more specifically to FIG. 1, the hose 24 extends out of the reel compartment 20 through the opening 19 therein and through a shield means which comprises a portion of a back wall 99 of the cleaning machine 10 and a vertically elongated, box-shaped structure 100 having three walls, inner and outer side walls, 102 and 104 respectively, and a rear wall, indicated generally at 106, having an upper portion 105, both edges of which are fastened to the side walls 102 and 104. It is to be understood that the shield means can be mounted on any part of the cleaning machine 10 from which the hose 24 extends without departing from the scope of the invention. It is to be further understood that the shielding means is not limited to the box-shaped structure 100 disclosed and could be, for example, a tubular structure without departing from the scope of the invention. The structure also comprises a top 107 fastened to the inner and outer sidewalls 102, 104 and the upper portion 105 of the rear wall 106. The lower portion of the rear wall 106 includes a door 108 hinged along the elongated edge of the outer side wall 104.

When the door 108 is closed, it forms the lower portion of the rear wall 106, and when opened (as shown) provides the operator with access to the hose 24 to facilitate inserting the hose 24 into the sewer opening 28 at the start of the cleaning operation. The side walls 102, 104 define an opening in the shield means and are fastened to the cleaning machine 10 so that the opening covers the opening 19 to the compartment 20 and the portion of the back wall 99 of the cleaning machine 10. Thus, the portion of back wall 99 and the structure 100 enclose the periphery of the exposed portion of the hose 24 and extends from the opening 19 in the reel compartment 20 and downwardly toward the sewer opening 28. The structure 100 is fabricated from sheet metal having a gauge sufficiently thick to contain the fragments and contents of a bursting hose so that the operator is protected while standing at the control panel 18.

The side walls 102, 104 and the rear wall 106 each have a lower portion or flaps 110, 112 and 114, respectively, rotatably connected by hinges 116, 118 and 120, respectively, so that they can be extended upwardly or raised when the cleaning machine 10 is being transported by the truck 12 and then lowered (as shown) for protection to cover the full length of the exposed portion of the hose 24 to the sewer opening 28 when the operator stops the truck 12 to commence the cleaning process. The reel 22 and the hose 24 are normally viewable by the operator through the opening 19 in the compartment 20. A portion of the inner side wall 102 is constructed with a plexiglass panel 121 so that the operator can still see the reel 22 and the hose 24 while standing at the control panel 18. The plexiglass panel 121 also has a gauge sufficiently thick to contain the fragments and contents of a bursting hose. The plexiglass panel 121 can be, for example, one-eighth inch shatter-proof plexiglass of the type manufactured by General Electric under the name LEXAN®.

Although the plexiglass panel 121 allows the operator to view the reel 22 and the hose 24 while standing at the control panel 18, spurious reflections from the panel 121 such as sun glare can obstruct the operator's view. Thus, a light shield 122 is mounted on the rear of the cleaning machine 10 and positioned to block sun light and other obstructing sources of light. The shield 122 is positioned as close to the plexiglass panel 121 as possible and between the control panel 18 and the obstructing source of light. The shield 122 is preferrably hinged to the cleaning machine 10 so that it can be folded under the door 16.

Another problem with using the plexiglass panel 121 relates to the steam that rises out of the sewer 30 into the box-shaped structure 100 posititoned over the sewer opening 29. The rising steam is trapped inside of the structure 100 and condenses on the plexiglass panel 121 so that the condensation obstructs the operator's view of the reel 22 and the hose 24. The situtation is worse during cold weather when the condensation freezes and accumulates. This problem was solved by installing a fan 123 (See FIG. 7) in the top 107 of the structure 100 so that the fan 123 forces outside air down the inside of the structure 100 to prevent the steam from entering the structure 100. As a result, the plexiglass panel 121 remains clear so that the operator's view is not obstructed.

Figure 3:
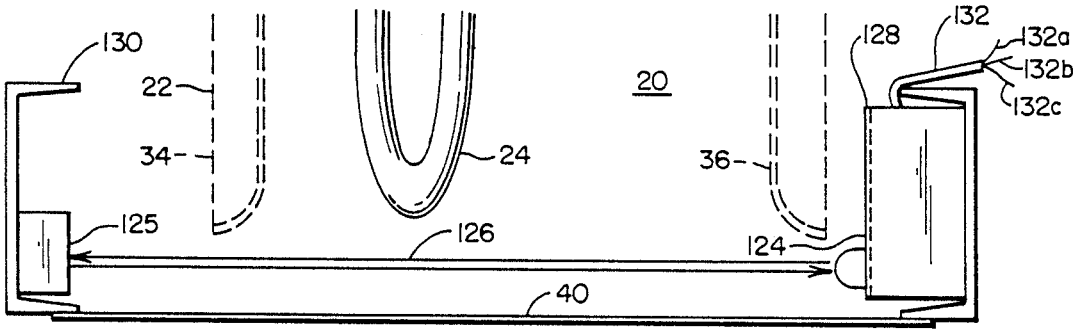
FIG. 3 is a fragmentary rear sectional view of the floor of the reel compartment further enlarged and taken along 3—3 in FIG. 2 to show a first embodiment of the sensing means constructed according to the present invention.
Figure 4:
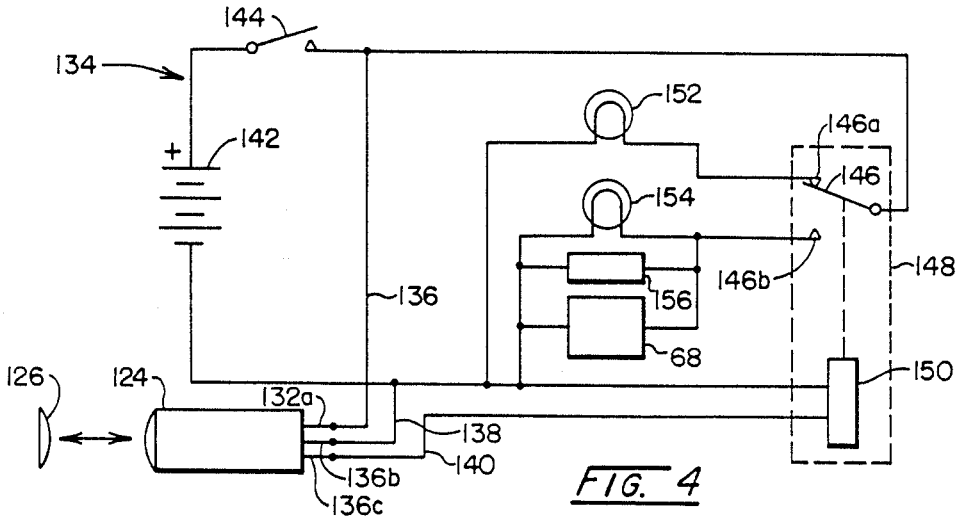
FIG. 4 is an electrical schematic of the actuating means and the sensing means constructed according to the present invention.

Even though the shield is constructed with a plexiglass panel 121 so that the operator cans still see the reel 22 and hose 24, the shield means limits the angle of view and consequently visibility to a certain extent. Therefore, it is desirable to have a sensing means mounted below the reel 22 for detecting a loop of hose 24 descending from the reel 22. A first embodiment of a sensing means is an optical sensing means comprising a photo-optical detector 124 (FIGS. 3 and 4) and a reflector 125 mounted by brackets 128, 130 on the floor 40 of the compartment 20. The detector 124 produces a light beam 126 that is reflected by the reflector 125 back to the detector 124. The detector 124 and reflector 125 are positioned under the reel 22 and the hose 24 so that the path of the light beam 126 will be interrupted by a descending loop of the hose 24 if it unravels from the reel 24. The detector 124 is connected via a cable 132 to actuating means comprising a circuit indicated generally at 134 as shown FIG. 4. The cable 132 provides three wires **132*a*, 132*b* and 132*c* from the detector 124 which are connected to wires 136, 138 and 140 of the circuit 134. The circuit 134 further compries a battery 142 having a positive terminal connected through a normally-opened switch 144 to the wire 136 and the common terminal of a double-pole switch 146 of a relay 148. The negative terminal of the battery 142 is connected to the wire 138 and the coil 150 of the relay 148, the other end of which is connected to the wire 140. A green lamp 152 (see also FIG. 1) is connected to the first pole 146*a* of the relay switch 146 and to the negative terminal of the battery 142. A red lamp 154 (see also FIG. 1) is connected in parallel with a buzzer 156 and the hydraulic dump valve 68 to the second pole 146*b* of the relay switch 146 and the negative terminal of the battery 142**.

Figure 5:
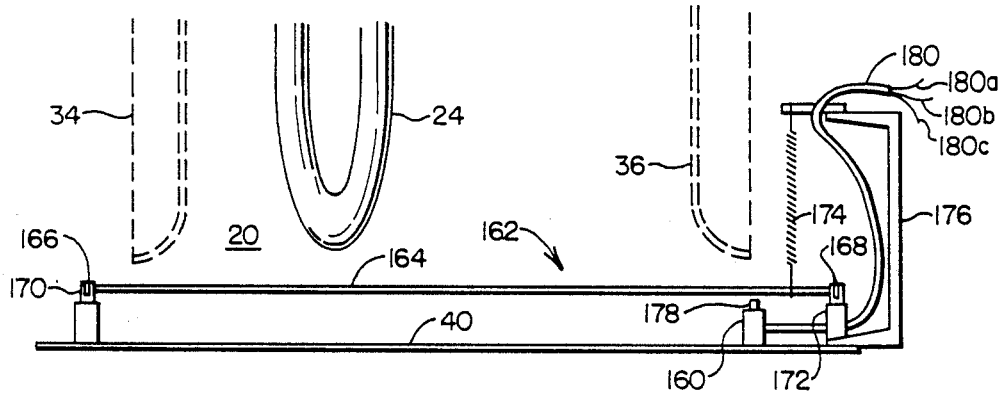
FIG. 5 is a fragmentary rear sectional view of the floor of the reel compartment further enlarged and taken along 3—3 in FIG. 2 to show a second embodiment of the sensing means constructed according to the present invention.
Figure 6:
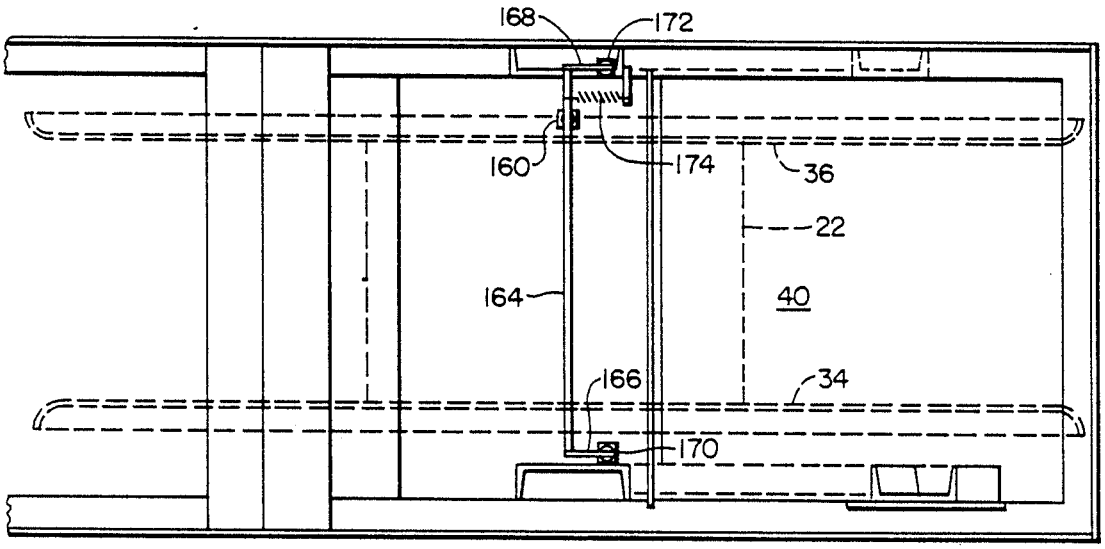
FIG. 6 is a fragmentary plan view of the reel compartment as shown in FIG. 5.

Another embodiment of the sensing means is a mechanical sensing assembly which comprises a microswitch 160 and a rod assembly indicated generally at 162 as shown in FIGS. 5 and 6. The rod assembly 162 comprises a metal rod 164 supported at both ends by support arms 166, 168 which are pivotally mounted in support studs 170, 172 mounted on the floor 40 of the compartment 20. The sensing bar assembly 162 further comprises a spring 174 suspended by a bracket 176 to hold the rod 164 adjacent the microswitch contact 178. When a loop in the hose 24 begins to descend, it will push the rod 164 downwardly against the microswitch contact 178. When the contact 178 is depressed, a signal is sent via a cable 180 to the circuit 134, referring to FIG. 4. The cable 180 provides three wires **180*a*, 180*b* and 180*c* from the microswitch 160 that are connected to the wires 136, 138 and 140 respectively, and operate as an alternative embodiment and substitute for the photo-optical detector 124**.

Prior to using the shield means, the operator manually leveled the hose 24 on the reel 22 while it was being wound in and out of the sewer during the cleaning operator. The shield means, however, encloses the hose 24 during the cleaning operation so that the hose 24 is not accessible. The inaccessibility of the hose 24 mandated the use of the level-wind 80 to automatically level the hose 24 on the reel as described hereinabove. The operation of the level-wind 80 requires that the forward motion of the hose 24 rotates the roller 90 so that it moves laterally with the hose 24 along the slide bar 96. When the hose 24 gets wet, however, it becomes too slippery to turn the roller 90. As a result, the hose 24 cannot move the roller 90 laterally on the slide bar 96. This problem has been solved by designing the inside width of the roller 90 to properly match the diameter of the hose 24.

Referring more specifically to FIG. 8, the roller 90 has a circumferential groove or path 91 for the hose 24. The surface of the groove 91 is slightly V-shaped pointing radially inward and bordered by opposingly-faced sidewalls 92. When the hose 24 is pulled by the nozzle 26 or the reel 22 and bent around the roller 90 over the arc of contact, the arced portion of the hose 24 is deformed in such a way that its cross-section becomes slightly flattened from a circular shape to an elliptical shape 25. The inside width of the roller 90 between the sidewalls 92 is slightly smaller than the major diameter of the flattened portion of the hose 25 so that its fits more tightly within the roller 90 and increases the frictional surface over the arc of contact. As a result, the hose 24 turns the roller 90 even when wet so that the roller 90 moves laterally with the hose 24 along the slide bar 96.

In operation, a length of hose 24 is unwound from the reel 22 at the rear of the truck 12 into the sewer 30. The reel 22 is rotated by the motor 50 which is controlled by the operator standing at the control panel 18 along side the structure 100. As the nozzle 26 pulls and advances the hose 24 through the sewer line 32, the hose 24 is unwound from the reel 22 by the motor 50, the speed and direction of which are controlled by the operator who continually watches the lower portion of the reel 22 and the hose 24 through the plexiglass portion 122 of the side wall 102 for a descending loop forming in the hose 24. As long as a descending loop does not form in the hose 24, the sensing means provides no signal to energize the coil 150 of the relay 148. As a result, the switch 146 is in its normal position providing a current path through the first pole **146*a* to illuminate the green light 152 as an indication to the operator that the nozzle 26 is moving unimpeded through the sewer pipe 32**.

During this time, the nozzle 26 may encounter a substantial amount of refuse and debris in the sewer pipe 32 which momemtarily hinders the advancement of the hose 24. If the operator does not notice this condition and neither slows down the motor 50 nor reverses the motor 50 by using the lever 58, the reel 22 will unwind the hose 24 faster than it is being advanced by the nozzle 26. This will produce an excess slack of hose 24 which will initally be manifested by a loop in the hose 24 descending to the floor 40 of the reel compartment 20. When the sensing means senses the presence of this loop by either interrupting the light beam 126 or dropping down on the rod 164, the stop signal will energize the coil 150 of the relay 148 and move the position of the switch 146 to the second pole **146*b*. As a result, the green light 152 is turned off and the red light 154 and the buzzer 156 are energized so that the operator is given a visible and audible warning that the hose 24 is unraveling from the reel 22. Even if the operator is not present or the warning system 152, 154, 156 is left deactivated by the operator in a manual mode, the switch 146 causes the hydraulic dump valve 168 to be activated which automatically stops the rotation of the reel 22 and the motor 50 by diverting the flow of hydraulic fluid from the motor 50 to the storage tank 60 via the hydraulic line 78. This will prevent the hose 24 from becoming wedged or entangled in the reel compartment 20. As the nozzle 26 again begins to move through the sewer pipe 32, the loop in the hose 24 begins to tighten on the reel 22 and rise out from the path of the light beam 126 or off of the rod 164. When this occurs, the switch 146 deactivates the dump value 168 so that the motor 50 resumes rotating the reel 22**. Thus, the entire correction process can be accomplished safely without any human intervention.

Having described the invention in detail and by reference to preferred embodiments thereof, it will be apparent that other modifications and variations are possible without departing from the scope of the invention defined in the appended claims. For example, the shielding means could be a tubular structure rather than the box-shaped structure 100 specifically described above.

What is claimed is:

1. Protection apparatus in a mobile sewer cleaning machine having a compartment enclosing a reel and a hose wound thereon, the compartment having an opening through which the hose can be unwound into a sewer through a sewer opening, a portion of the hose between the opening in the compartment and the sewer being exposed, the reel and the hose being viewable through the opening in the compartment and being rotated by a motor to advance the hose through the sewer, comprising:

shield means for enclosing the periphery of the exposed portion of the hose received through an opening therein and extending substantially the full length of the exposed portion of the hose toward the sewer opening, said shield means having a transparent portion for viewing the reel and the hose; and, means for fastening said shield means to the cleaning machine so that said shield means covers the opening in the compartment;

whereby said shield means will deflect fragments and contents of a bursting hose, while permitting the reel and the hose to remain viewable.

2. Protection apparatus as recited in claim 1 wherein said protection apparatus further comprises sensing means, mounted below the reel and hose, for sensing the presence of a descending loop of the hose from the reel and for providing a stop signal in response thereto, and actuating means connected to said sensing means for stopping the motor in response to said stop signal, whereby said sensing and actuating means prevent the hose from unwinding and backing up in the compartment when the hose is unwound by the motor at a rate which is faster than the rate at which it advances through the sewer.

3. Protection apparatus as recited in claim 2 wherein said sensing means is an optical sensing means for producing a light beam and for providing said stop signal when said light beam is interrupted by a descending loop.

4. Protection apparatus as recited in claim 2, wherein said sensing means is a mechanical sensing assembly comprising a rod assembly for receiving a descending loop of the hose and downwardly movable in response thereto, and switching means responsive to the downward movement of said rod assembly for providing said stop signal.

5. Protection apparatus as recited in claim 1, further comprising leveling means, mounted in the upper area of the compartment of said cleaning machine and rotationally connected to the reel, for moving the hose laterally in a direction substantially parallel to the rotational axis of the reel as the motor rotates the reel to wind the hose levelly in successive layers on the reel.

6. Protection apparatus as recited in claim 5, further comprising a slide bar mounted in the upper area of the compartment of said cleaning machine and a roller, mounted for rotation and lateral movement on said slide bar, adapted for receiving the hose from said leveling means and suspending the hose over the sewer opening, the hose bending over an arc of contact with said roller and having a portion flattened by said contact, said roller having a circumferential path bordered by oppossingly-faced sidewalls within which the flattened portion of the hose fits so that said roller is rotated by and moves laterally with the hose.

7. Protection apparatus as recited in claim 1, wherein said shield means is extendable in length over the full length of the exposed portion of the hose to cover the sewer opening.

8. Protection apparatus as recited in claim 7, wherein said shield means also has an access portion openable to provide access to the hose from outside said shield means.

9. Protection aparatus as recited in claim 1, further comprising means for moving air through said shield means toward the end thereof adjacent the sewer opening to prevent steam from moving into said shield means from the sewer.

10. Protection apparatus as recited in claim 1, further comprising means, adjacent the transparent portion of said shield means, for shielding the transparent portion from bright light sources to prevent reflections therefrom that obstruct visibility through the transparent portion.

11. Protection apparatus in a mobile sewer cleaning machine having a compartment enclosing a reel and a hose wound thereon, the compartment having an opening through which the hose can be unwound into a sewer through a sewer opening, and a motor for rotating the reel to advance the hose through the sewer, comprising:

leveling means, mounted in the upper area of the compartment and rotationally connected to the reel, for moving the hose laterally in a direction substantially parallel to the rotational axis of the reel as the motor rotates the reel to wind the hose levelly in successive layers on the reel;

a slide bar mounted in the upper area of the compartment; and, a roller, mounted for rotation and lateral movement on said slide bar, adapted for receiving the hose from said leveling means and suspending the hose over the sewer opening.

12. Protection apparatus as recited in claim 11, wherein the hose bends over an arc of contact with said roller and has a portion flattened by said contact, said roller having a circumferential path bordered by oppos-ingly-faced sidewalls within which the flattened portion of the hose fits so that said roller is rotated by and moves laterally with the hose.

13. Protection apparatus in a mobile sewer cleaning machine having a compartment enclosing a reel and a hose wound thereon, the compartment having an opening through which the hose can be unwound into a sewer through a sewer opening, and a motor for rotating the reel to advance the hose through the sewer, comprising:

sensing means, mounted below the reel and the hose, for sensing the presence of a descending loop of the hose from the reel and for providing a stop signal in response thereto; and actuating means, connected to said sensing means, for stopping the motor in response to said stop signal;

whereby, said sensing and actuating means prevent the hose from unwinding and backing up in the compartment when the hose is unwound by the motor at a rate which is faster than the rate at which is advances through the sewer.

14. Protection apparatus as recited in claim 13, wherein said sensing means is an optical sensing means for producing a light beam and for providing a stop signal when said light beam is interrupted by a descending loop.

15. Protection apparatus as recited in claim 13, wherein said sensing means is a mechanical sensing assembly comprising a rod assembly for receiving a descending loop of the hose and downwardly movable in response thereto, and switching means responsive to the downward movement of said rod assembly for providing said stop signal.

16. Protection apparatus in a mobile sewer cleaning machine having a compartment enclosing a reel and a hose wound thereon, the compartment having an opening through which the hose can be unwound into a sewer through a sewer opening, a portion of the hose between the opening in the compartment and the sewer being exposed, the hose and reel being viewable through the opening in the compartment, and a motor for rotating the reel to advance the hose through the sewer, comprising:

shield means for enclosing the periphery of the exposed portion of the hose received through an opening therein and extending substantially the full length of the exposed portion of the hose toward the sewer opening;

means for fastening said shield means to the cleaning machine so that the opening of said shield means is aligned with the opening in the compartment;

sensing means, mounted below the reel and the hose, for sensing the presence of a descending loop of hose from the reel and for providing a stop signal in response thereto; and, actuating means, connected to said sensing means, for stopping the motor in response to said stop signal;

whereby, said shield means contains the fragments and contents of a bursting hose while said sensing means and actuating means prevent the hose from unwinding and backing up in the compartment when the hose is unwound by the motor at a rate which is faster than the rate at which it advances through the sewer.

17. Protection apparatus as recited in claim 16, wherein said shield means has a transparent portion for viewing the reel and the hose.

18. Protection apparatus as recited in claim 17, further comprising means for moving air through said shield means toward the end thereof adjacent the sewer opening to prevent steam from moving into said shield means from the sewer.

19. Protection apparatus as recited in claim 17, further comprising means, adjacent the transparent portion of said shield means, for shielding the transparent portion from bright light sources to prevent reflections therefrom that obstruct visibility thorugh the transparent portion.

20. Protection apparatus as recited in claim 16, further comprising leveling means, mounted in the upper area of the compartment of said cleaning machine and rotationally connected to the reel, for moving the hose laterally in a direction substantially parallel to the rotational axis of the reel as the motor rotates the reel to wind the hose levelly in successive layers on the reel.

21. Protection apparatus as recited in claim 20, further comprising a slide bar mounted in the upper area of the compartment of said cleaning machine and a roller, mounted for rotation and lateral movement on said slide bar, adapted for receiving the hose from said leveling means and suspending the hose over the sewer opening, the hose bending over an arc of contact with said roller and having a portion flattened by said contact, said roller having a circumferential path bordered by opposingly-faced sidewalls within which the flattened portion of the hose fits so that said roller is rotated by and moves laterally with the hose.

22. Protection apparatus as recited in claim 16, wherein said shield means is extendable in length over the full length of the exposed portion of the hose to cover the sewer opening.

23. Protection apparatus as recited in claim 16, wherein said shield means also has an access portion openable to provide access to the hose from outside said shield means.

24. Protection apparatus as recited in claim 16, wherein said sensing means is an optical sensing means for producing a light beam and providing a stop signal when said light beam is interrupted by a descending loop.

25. Protection apparatus as recited in claim 16, wherein said sensing means is a mechanical sensing assembly comprising a rod assembly for receiving a descending loop of the hose and downwardly movable in response thereto, and switching means responsive to the downward movement of said rod assembly for providing said stop signal.

26. Protection apparatus as recited in claim 16, wherein: said shield means comprises a portion of a back wall of the cleaning machine and a vertically elongaged, box-shaped structure having three walls, a pair of sidewalls and a rear wall fastened therebetween, said sidewalls defining the opening in said shield means and being fastened to the cleaning machine so that the periphery of the opening covers the opening in the compartment and said portion of the back wall of the cleaning machine.

27. Protection apparatus as recited in claim 26, wherein: a portion of at least one wall of said box-shaped structure is transparent for viewing the reel and the hose.

28. Protection apparatus as recited in claim 26, wherein: one of said walls of said box-shaped structure has an access portion openable to provide access to the hose from outside said shield means.

29. Protection apparatus as recited in claim 26, wherein each wall of said box-shaped structure has a lower portion hinged thereto so that said box-shaped structure is extendable in length over the full length of the exposed portion of the hose by positioning said hinged portions to extend toward the sewer opening.

* * * * *